US011992132B2

(12) United States Patent
Longenecker et al.

(10) Patent No.: US 11,992,132 B2
(45) Date of Patent: May 28, 2024

(54) QUICK CONNECTING CHILD BOOSTER SEAT

(71) Applicant: ARTSANA USA, INC., Lancaster, PA (US)

(72) Inventors: Michael L. Longenecker, Lancaster, PA (US); Raymond Evan Good, Lancaster, PA (US)

(73) Assignee: Artsana USA, Inc., Lancaster, PA (US)

( * ) Notice: Subject to any disclaimer, the term of this patent is extended or adjusted under 35 U.S.C. 154(b) by 127 days.

(21) Appl. No.: 17/939,383

(22) Filed: Sep. 7, 2022

(65) Prior Publication Data

US 2024/0074596 A1 Mar. 7, 2024

(51) Int. Cl.
*A47D 1/00* (2006.01)
*A47D 1/10* (2006.01)

(52) U.S. Cl.
CPC ..... *A47D 1/103* (2013.01); *A47D 1/006* (2013.01); *A47D 1/10* (2013.01)

(58) Field of Classification Search
CPC ..... A47D 1/103; A47D 1/006; A47D 1/10
See application file for complete search history.

(56) References Cited

U.S. PATENT DOCUMENTS

| | | | | |
|---|---|---|---|---|
| 628,306 | A * | 7/1899 | Farrington | A47D 1/103 297/152 |
| 2,521,281 | A * | 9/1950 | Brousseau | A47D 1/103 248/421 |
| 2,935,122 | A * | 5/1960 | Miller | A47D 1/004 297/151 |
| 3,126,226 | A * | 3/1964 | Johnson | A47D 1/106 297/254 |
| 4,629,247 | A * | 12/1986 | Wu | A47D 1/106 108/97 |
| 5,335,968 | A | 8/1994 | Sheridan et al. | |
| 7,422,276 | B2 | 9/2008 | Flannery | |
| 9,603,464 | B2 | 3/2017 | Sclare et al. | |
| 2018/0146793 | A1* | 5/2018 | Longenecker | A47D 1/02 |

FOREIGN PATENT DOCUMENTS

WO 2018199765 A1 11/2018

* cited by examiner

*Primary Examiner* — David R Dunn
*Assistant Examiner* — Tania Abraham
(74) *Attorney, Agent, or Firm* — Saxton & Stump, LLC

(57) ABSTRACT

A portable booster seat for supporting a child on a chair having a retractable clamping arm that is extendable to an underside surface of a chair seat and selectively moveable to clamp the booster seat to the chair.

8 Claims, 14 Drawing Sheets

QUICK CONNECTING CHILD BOOSTER SEAT

BACKGROUND OF THE INVENTION

This invention relates generally to portable seating for small children, and more particularly to a booster seat that may be quickly and conveniently attached to a seating surface of a chair or the like wherein securing the booster seat to the chair is managed though an easy-to-use user interface.

Portability and convenience of use of childcare accessories are increasingly important considerations among consumers. This is particularly important for child booster seats. Booster seats are designed to be placed in the seat of a chair to elevate a child occupant for improved access to an adjacent table. It is necessary to secure the booster seat to the chair to prevent the child from moving the booster seat to the point at which the booster seat falls from the chair. Known methods for securing the booster seats include straps and clamping mechanism, all of which are typically cumbersome to use suffer from somewhat compromised connection integrity. A booster seat having an easy-to-use mechanism for securing a booster seat to a chair or the like in which the mechanism also retracts into the booster seat when not in use would overcome limitations in the known art and be inherently beneficial.

SUMMARY OF THE INVENTION

Accordingly, the present invention, in any of the embodiments described herein, may provide one or more of the following advantages:

It is an object of the present invention to provide a portable child booster seat configured for attachment to a chair that includes a clamping mechanism for securing the seat to the chair that may be stowed within the periphery of the seat when not in use. The seat includes a moveable clamping arm connected at one end to the seat and having a drop-down portion with a moveable foot on the opposite end. The clamping arm is moveable between a clamping configuration and a stowed configuration. The clamping configuration allows the drop-down portion of the clamping arm to extend below the chair seat so that the moveable foot may be positioned adjacent to the underside of a chair seat. The clamping arm is rotatable for stowage so that clamping arm may be disposed within a recess in the bottom of the booster seat.

It is a still further object of the present invention to provide a portable child booster seat configured for attachment to a chair and having a clamping mechanism that is easy to operate and secure in attachment. The clamping mechanism comprises a moveable clamping arm connected at one end to the booster seat and having a drop-down frame portion with a moveable clamping foot on the opposite end. The clamping configuration allows the drop-down frame portion to extend below the chair seat so that the clamping foot may be positioned adjacent to the underside of a chair seat. A clamping mechanism manages movement of sliding block that couples the clamping arm to the seat base. A tensioning mechanism is provided to operate the clamping mechanism and retain it in a clamped configuration to secure the booster seat to a chair.

It is a further object of the present invention to provide an easily operable clamping mechanism for securely attaching a portable child booster seat to a chair. The clamping mechanism comprises a moveable clamping arm connected at one end to the booster seat and having a drop-down frame portion with a moveable clamping foot on the opposite end. The clamping configuration allows the drop-down frame portion to extend below the chair seat so that the clamping foot may be positioned adjacent to the underside of a chair seat. The clamping mechanism interface with the clamping arm permits bi-directional movement along a longitudinal axis to enable the clamping arm to be forwardly extended from the seat base and provide clearance between the clamping arm and the forward end of the chair seat while the booster seat is positioned thereon. The clamping mechanism interface with the clamping arm also enable rotational movement of the clamping arm about the longitudinal axis, but only when the clamping arm is linearly positioned in a retracted position. The rotational movement permits the clamping arm to be stowed within a recess formed in the seat base assembly and allow the booster seat to rest stably on a surface when the clamping arm is stowed.

It is a still further object of the present invention to provide an easily operable clamping mechanism for securely attaching a portable child booster seat to a chair that is durable in construction, inexpensive of manufacture, carefree of maintenance, easily assembled, and simple and effective to use.

These and other objects are achieved in accordance with the present invention by providing a portable child booster seat configured for attachment to a chair and having a moveable clamping arm that is easy to operate and secure the booster seat to a chair. The clamping arm is connected at one end to a clamping mechanism disposed on the seat base and has a drop-down frame portion with a moveable clamping foot on the opposite end. The clamping arm is moveable between a clamping configuration and a stowed configuration. The clamping arm may be stowed within a storage recess within base assembly when not in use. The clamping configuration allows the drop-down frame portion of the clamping to extend around the forward end of a chair seat and below the seat so that the clamping foot may be positioned adjacent to the underside of a chair seat. A tensioning mechanism repositions the clamping mechanism to bring the clamping foot into contact with the chair seat and apply a clamping force which retains the booster seat secure to the chair.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience and are determined as the seat frame would normally be positioned when clamped to a chair seat or similar surface to support a child. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all figures.

Figure 1:
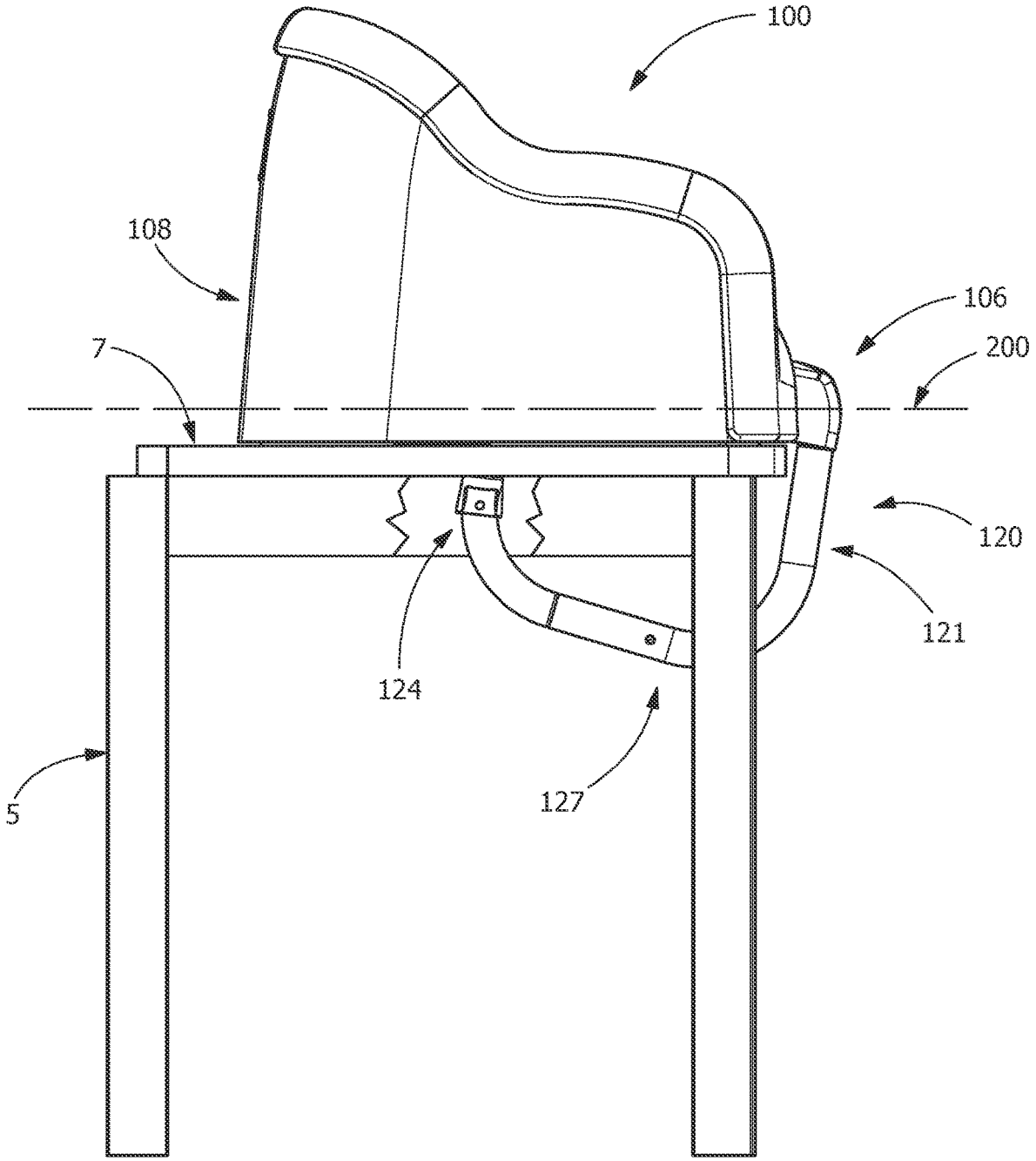
FIG. 1 is an elevation view of a quick connecting booster seat for a child embodying aspects of the present invention shown attached to a chair.
Figure 2:
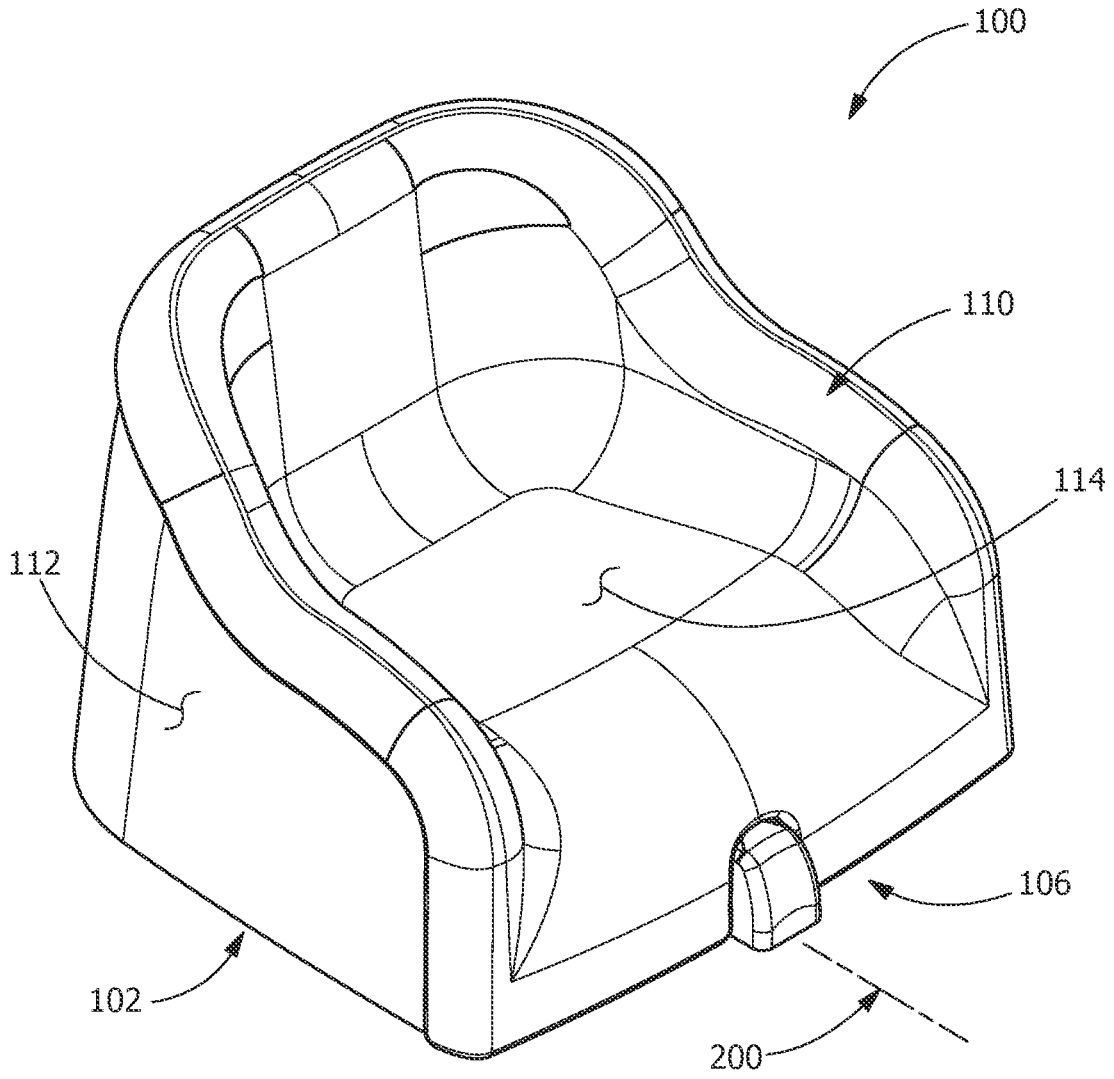
FIG. 2 is a perspective view of the quick connecting booster seat of FIG. 1.

Referring to the figures, a portable booster seat 100 embodying the present invention is shown in FIG. 1 positioned for use by attachment to a conventional chair 5. The booster seat 100 comprises a base 102 with a lower surface 104 for positioning on an upward-facing surface of a chair seat 7. A seat shell 110 extends upwardly from base 102 and has an exterior surface 112 configured to define an elevated seating area 114 for a child. The seat 100 and seating area are further defined as having a forward end 106 and a rearward end 108 defining a generally longitudinal first axis 200 therebetween. Seat shell 110 encloses a hollow interior space 118 above base 102 which contains a portion of a seat clamping mechanism 150 used to selectively secure the booster seat 100 to chair 5. The booster seat 100 is supported by adjacent contact between lower surface 104 and an upward-facing surface of chair seat 7 when positioned for use.

The lower surface 104 configuration defines a footprint preferably sized to fit within the periphery of seating surfaces of a large variety of chair types, particularly chairs used for dining. A footprint having dimension of approximately 16 inches by 16 inches number has been found suitable for most applications.

Figure 8:
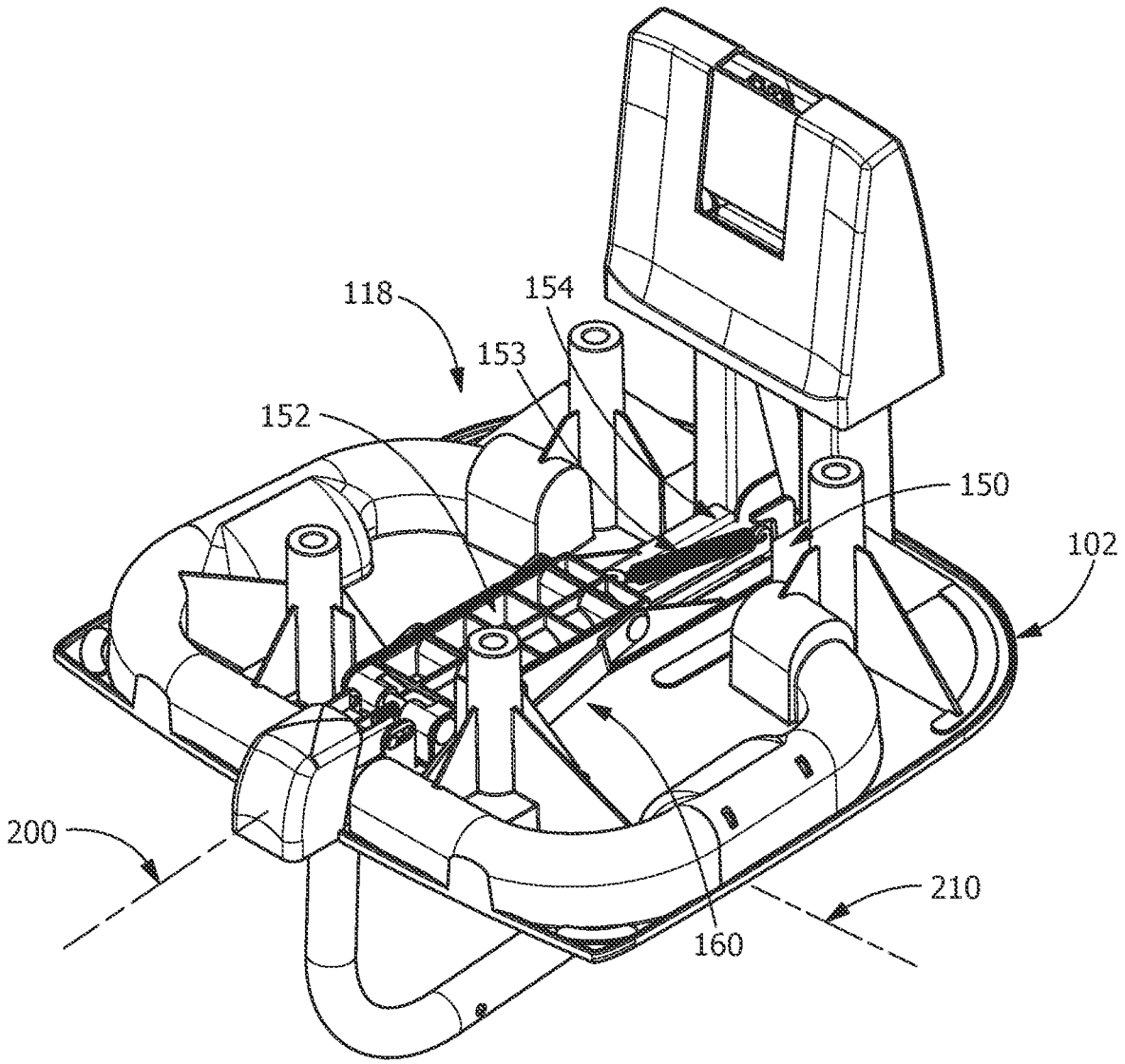
FIG. 8 is a partial interior view of the booster seat interior wherein the clamping mechanism is positioned as shown in FIG. 5.
Figure 9:
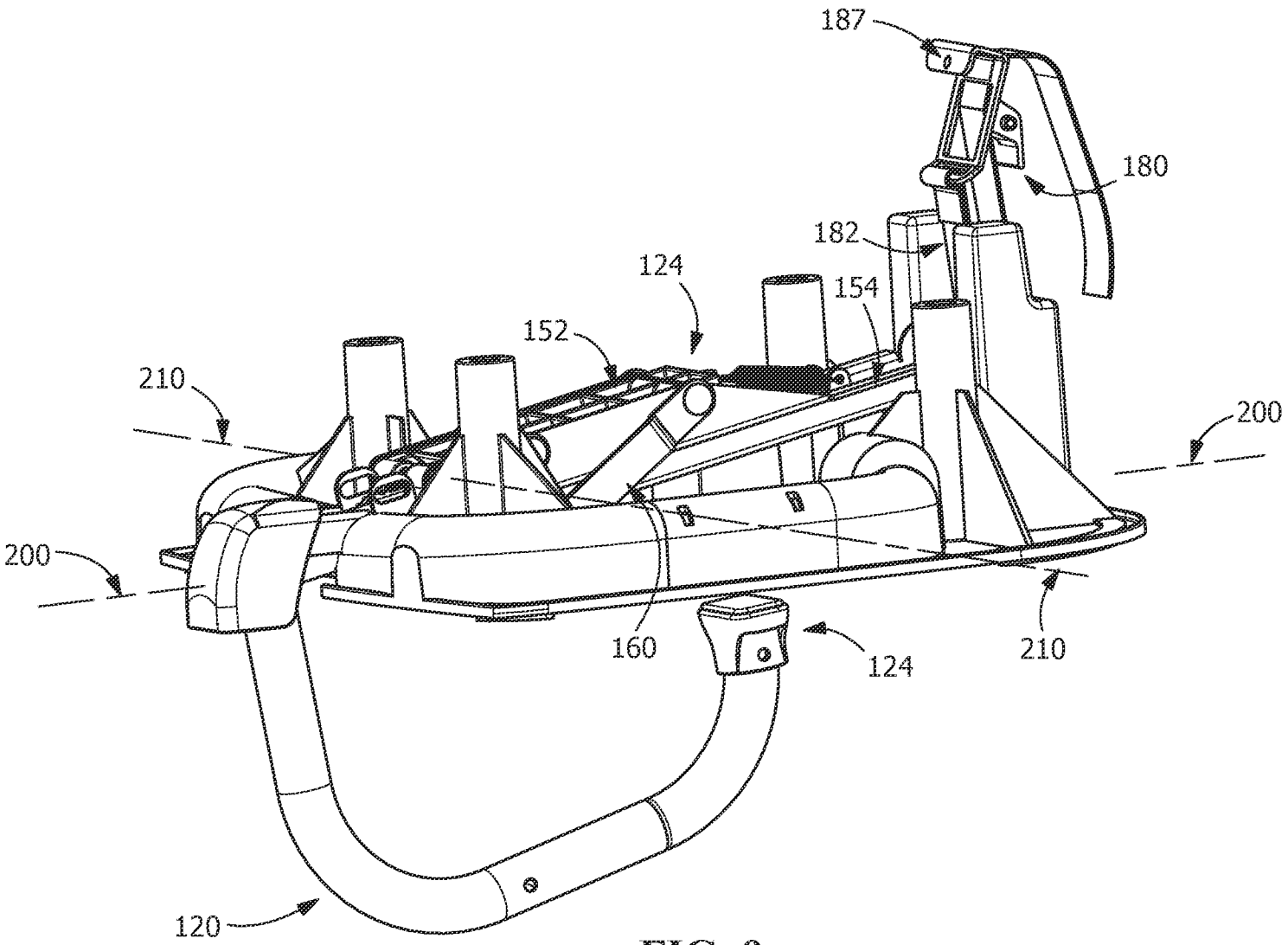
FIG. 9 is a partial view of the booster seat interior wherein the clamping mechanism is positioned as shown in FIG. 1.
Figure 10:
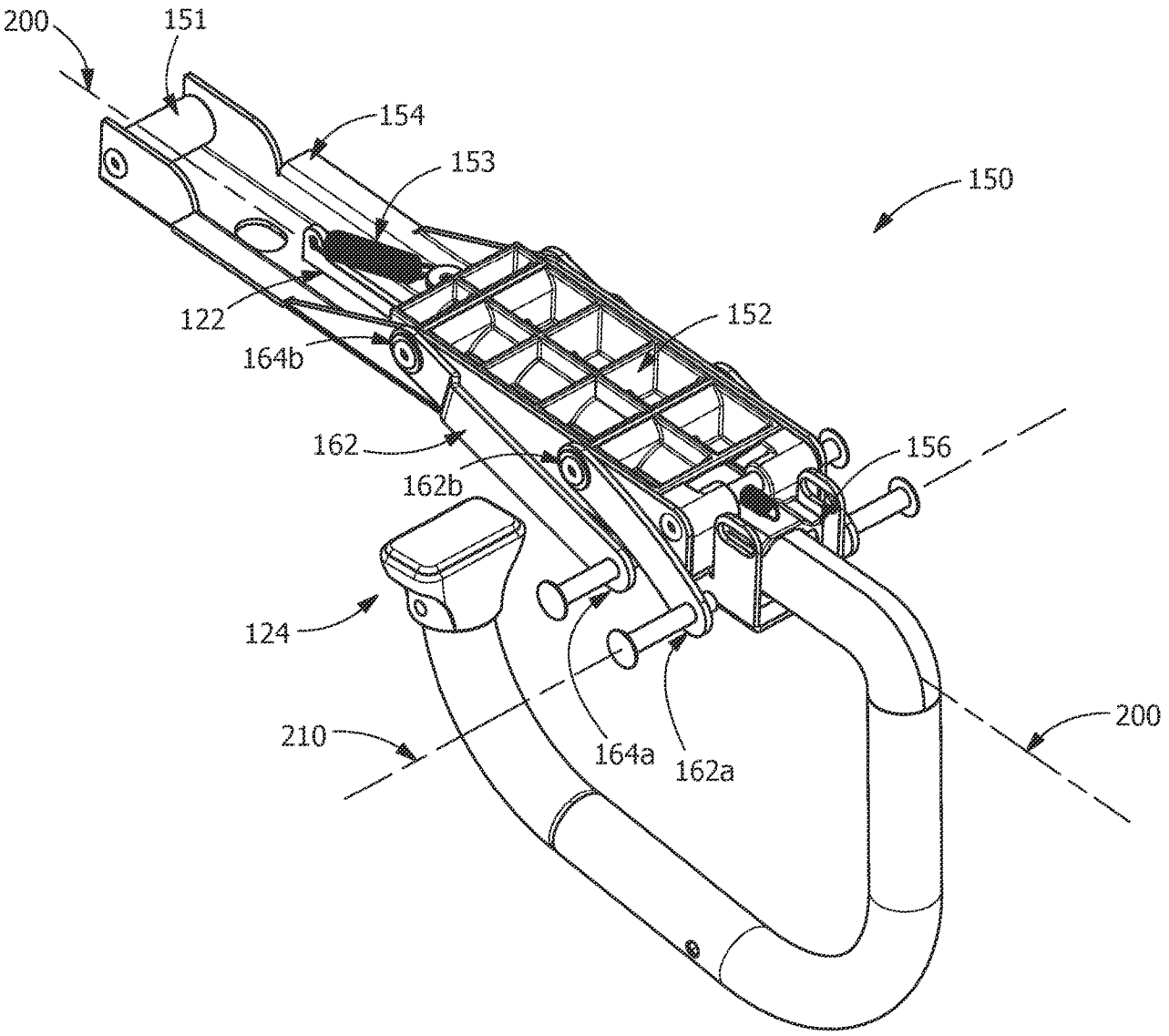
FIG. 10 is a partial view of the clamping arm and clamping mechanism of the booster seat.
Figure 11:
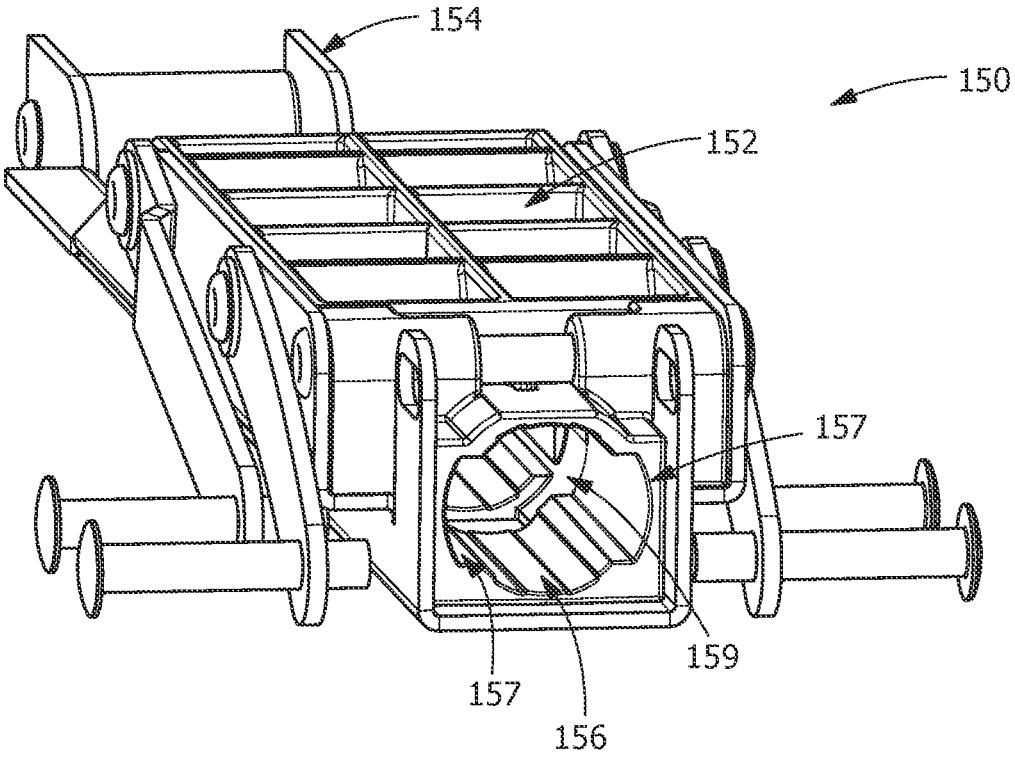
FIG. 11 is a detail view of a sliding block using in the clamping mechanism to manage motion of the clamping arm.
Figure 12:
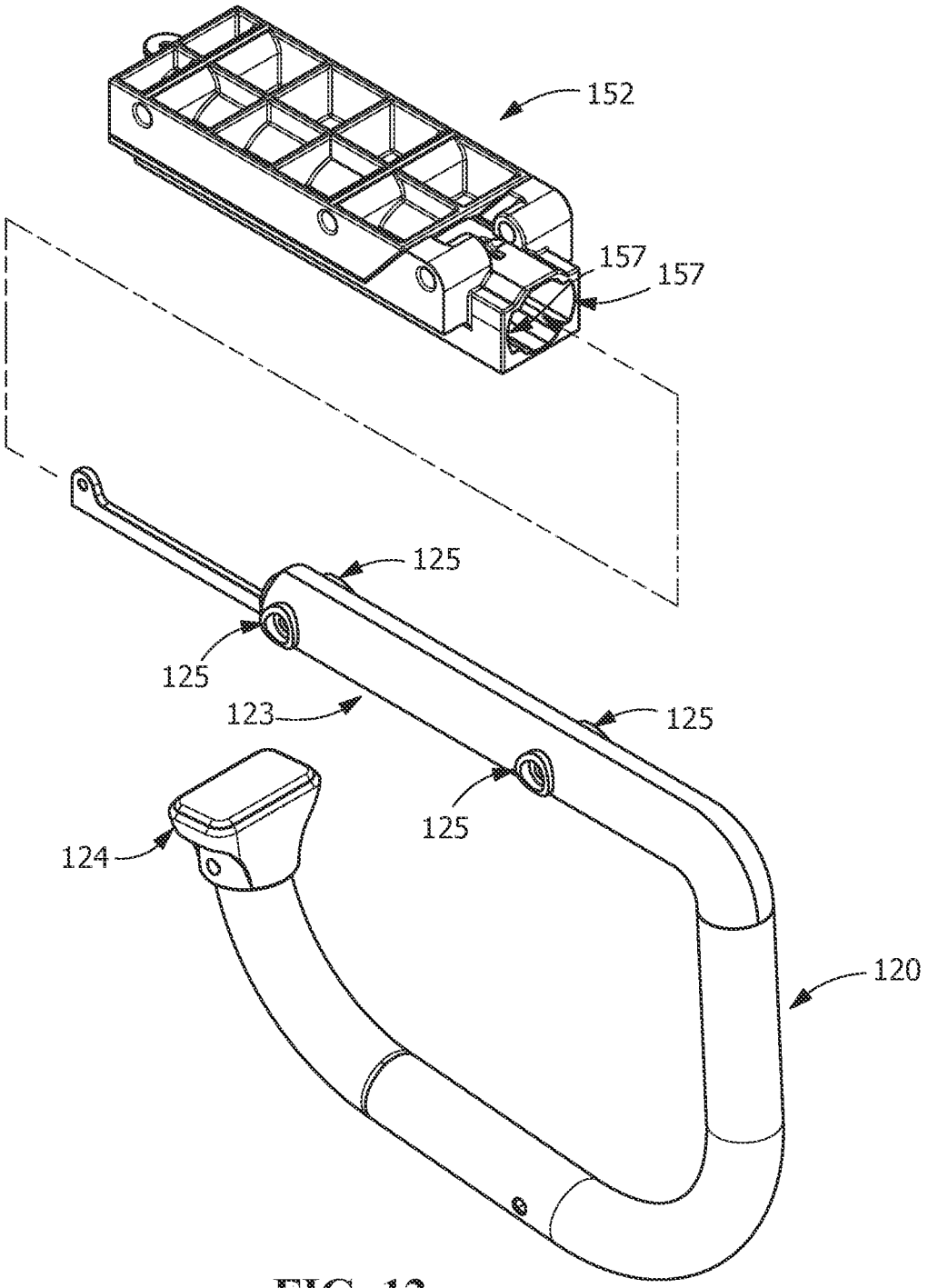
FIG. 12 is a partial exploded view of the sliding block and clamping arm.
Figure 13:
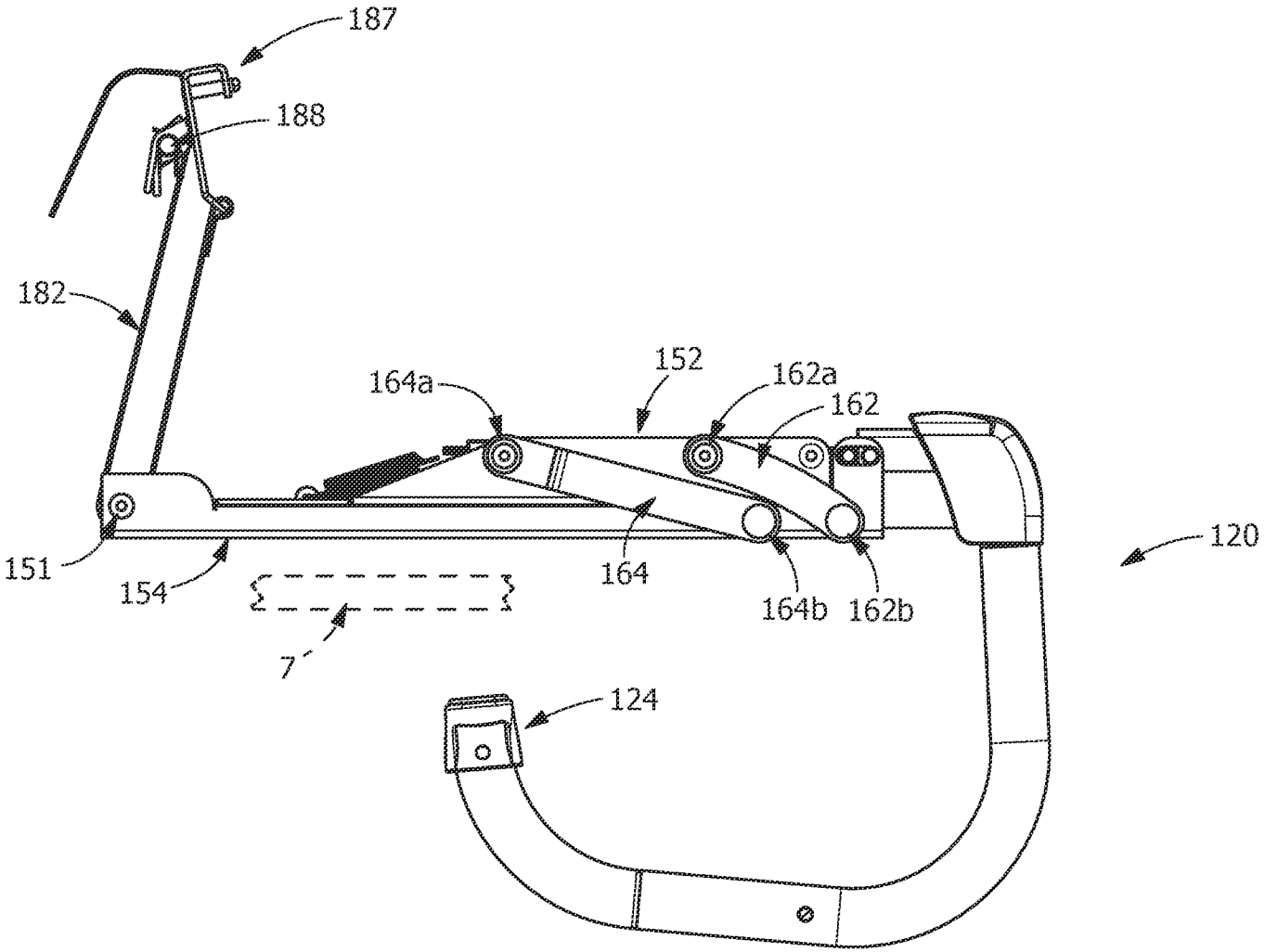
FIG. 13 is a partial view of an actuating mechanism shown in the released or unclamped position.
Figure 14:
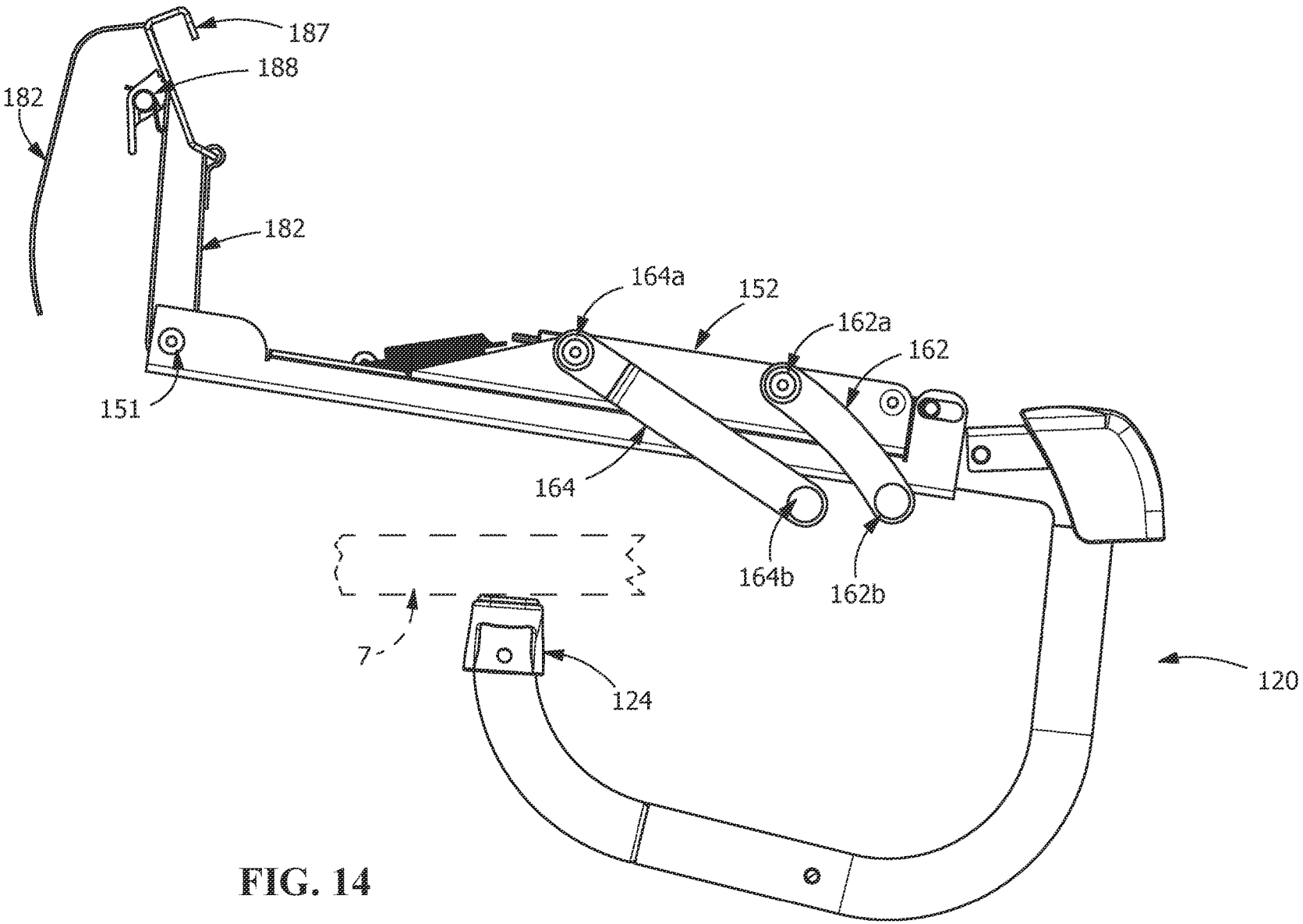
FIG. 14 is a partial view of the actuating mechanism of FIG. 13 shown when the clamping mechanism is in the clamped position.

Clamping mechanism 150 is connected to base 102 and includes a slide block 152 and a lifting bracket 154 structurally connected thereto. Slide block 152 is moveably disposed on the base assembly for rotational movement about a second axis 210 between generally opposing first (FIG. 8) and second positions (FIG. 9). Second axis 210, also referred to as a transverse axis, is generally transversely aligned to the base and orthogonal to longitudinal axis 200. Slide block 152 includes a guide opening 156 aligned on a longitudinal forward-rearward first axis 200 configured to receive an engagement portion 123 of the clamping arm 120 adjacent to a first end 122. Guide opening and the first end 122 of the clamping arm are configured to permit bi-directional movement of the clamping arm along the longitudinal first axis 200 between extended and retracted positions, and rotational movement of the clamping arm about the first axis between storage and deployed positions.

The engagement portion 123 of the clamping arm and slide block 152 may include provisions to limit rotational movement to only when the clamping arm is in one or more pre-determined longitudinal positions. In a preferred embodiment, rotational movement of the clamping arm is allowed only when the clamping arm is in the retracted position. In one embodiment, engagement portion 123 of the clamping arm includes one or more lugs 125 radially extending from the engagement portion which engage guide bearings 157 in the guide opening to inhibit clamping arm rotation when it is not in the retracted position while allowing sliding movement along the longitudinal axis. Guide opening 156 may also include a guide channel 159 which permits the lugs 125 and the engagement portion 123 to rotate about longitudinal axis 200 when the clamping arm is in the retracted position and the lugs aligned in the guide channel. The engagement of lugs 125 in guide channel 159 also restrains the clamping arm in the retracted position, resisting the biasing force of resilient element 153 toward the extended position.

Clamping arm 120, when deployed for clamping use, is a generally C-shaped structure that extends from a forward end 106 of the base 102 forwardly, downwardly, and finally rearwardly to position a distal end 124 of the clamping arm 120 generally beneath and spaced apart from base 102. The clamping arm includes a drop-down portion 121 and a rearwardly extending extension portion 127 to which a clamping foot 124 is distally connected. This configuration allows the clamping arm 120 to extend generally around the forward end of the chair seat 7 and position clamping foot 124 beneath the underside of the chair seat so that the chair seat is positioned between clamping foot and the lower surface 104 allowing the chair seat to be clamped therebetween.

Figure 4:
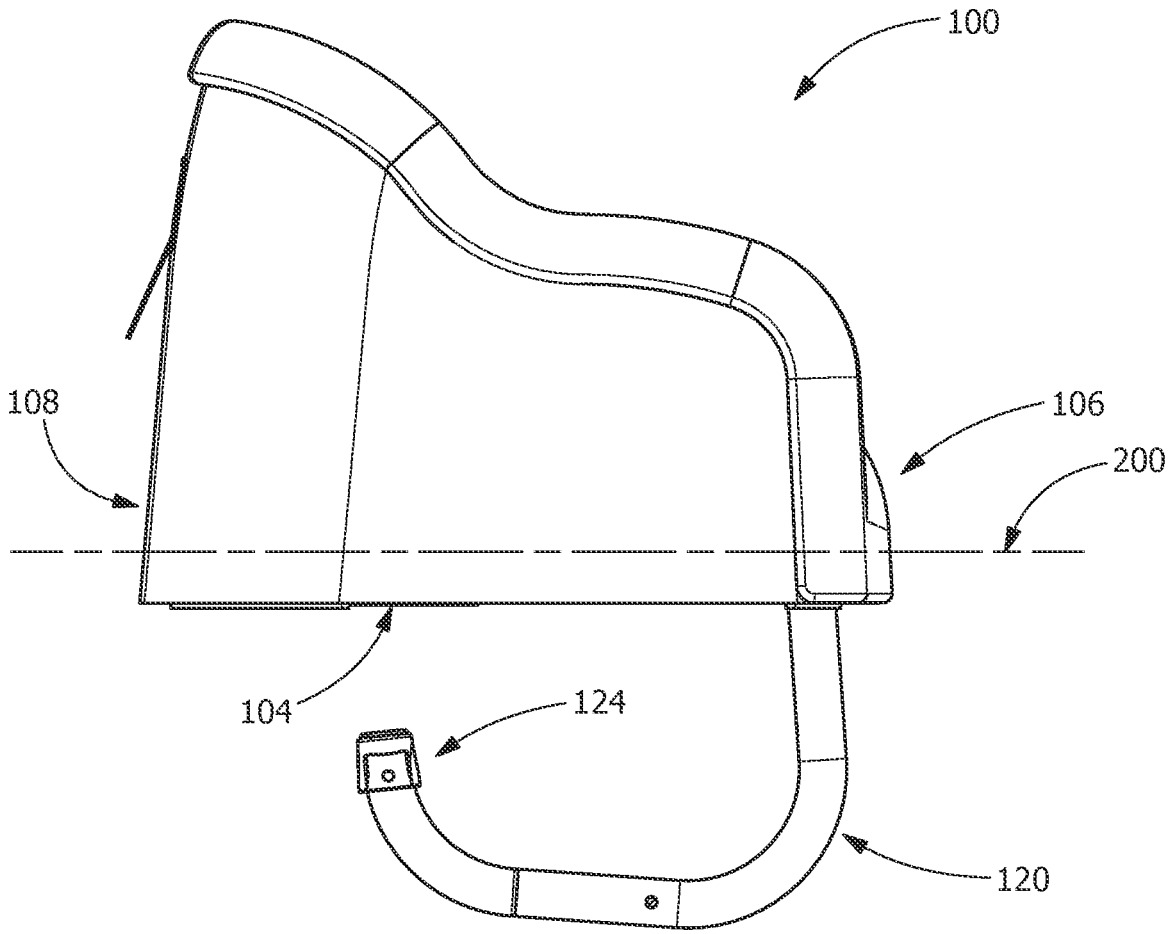
FIG. 4 is a side elevation view the booster seat of FIG. 1 shown with the clamping apparatus shown in the first step for repositioning in a preparation for clamping to a chair.
Figure 5:
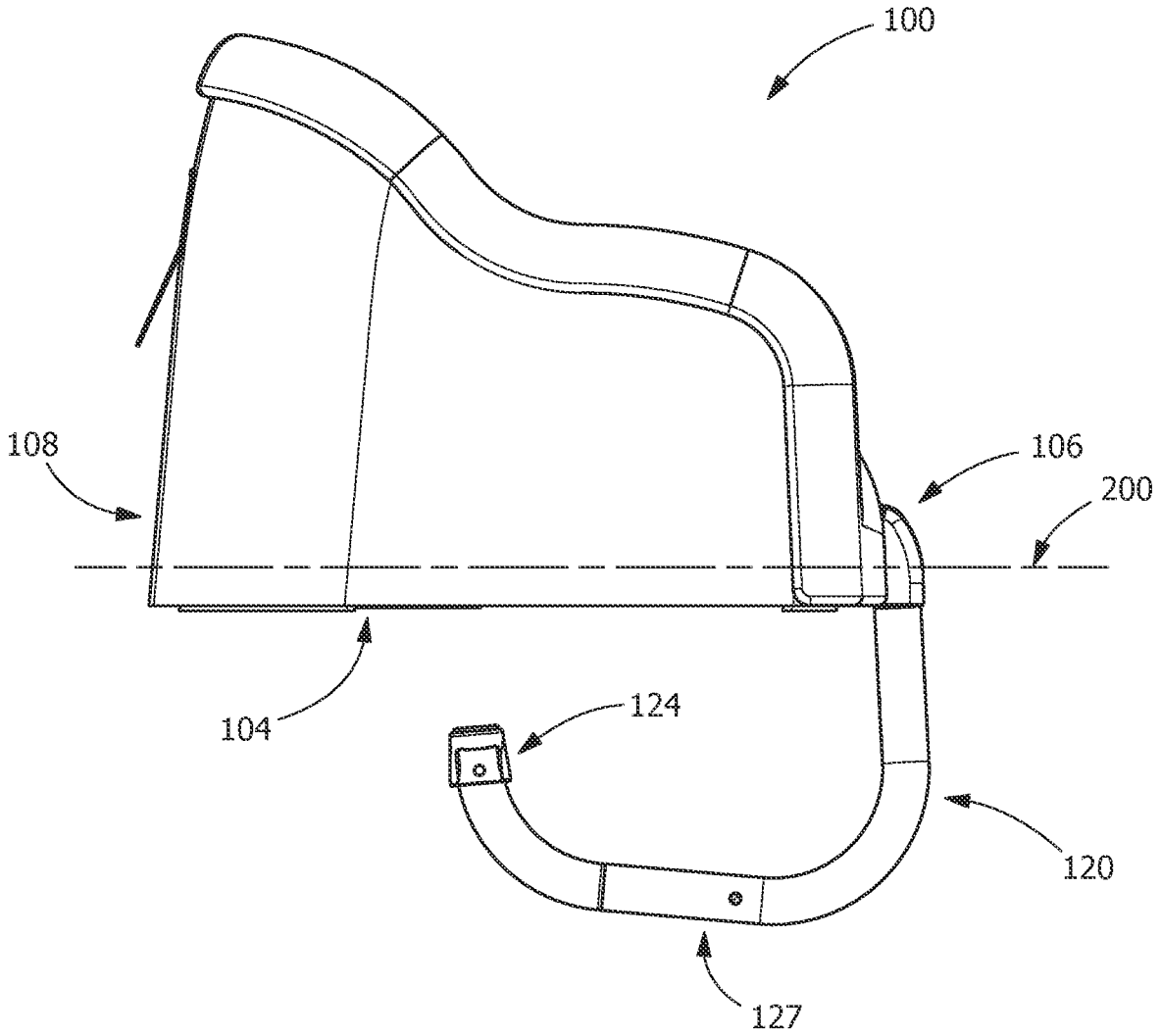
FIG. 5 is a side elevation view of the booster seat shown in FIG. 4, wherein the clamping apparatus has been extended in preparation for clamping to the chair.
Figure 6:
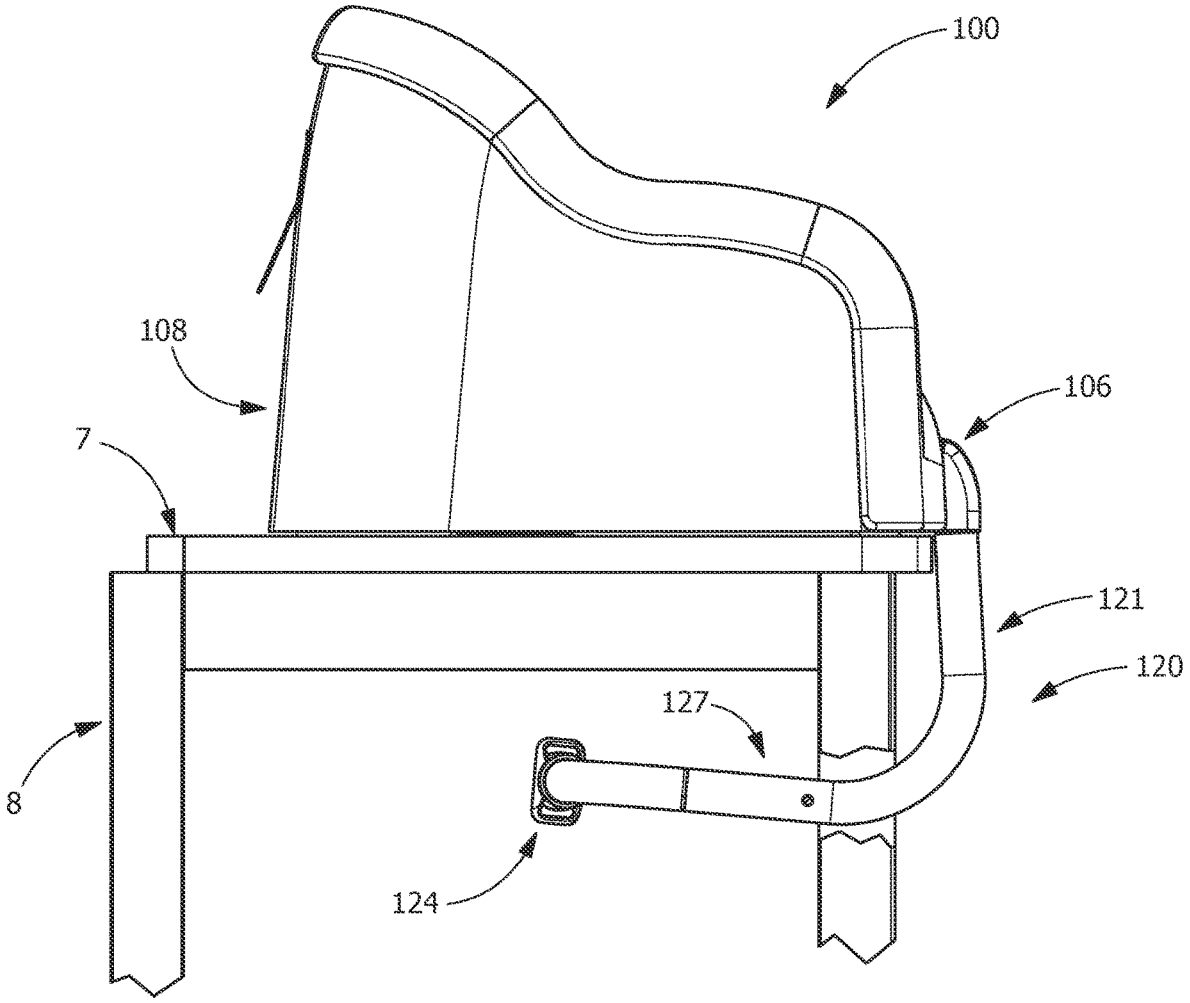
FIG. 6 is a side elevation view of the of the booster seat shown in FIG. 5, wherein the clamping apparatus is repositioned to ease installation on the chair.
Figure 7:
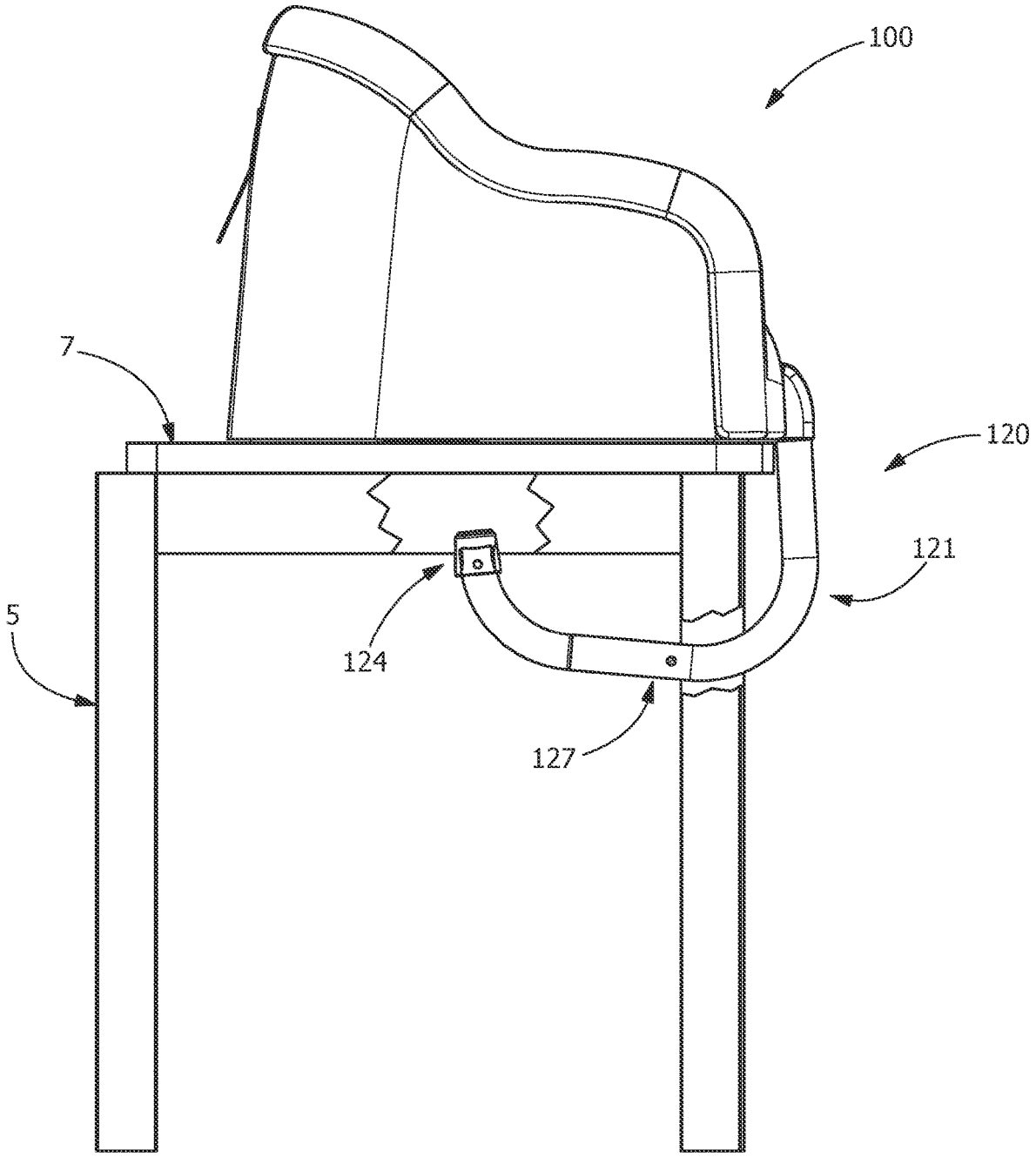
FIG. 7 is a side elevation view of the booster seat shown in FIG. 7, wherein the clamping apparatus is positioned in preparation for clamping to the chair.

Longitudinal movement of the clamping arm along the first axis 200 is enabled between retracted (FIG. 4) and extended positions (FIG. 5). When in the retracted position, clamping arm 120 is disposed substantially within the footprint of the base when viewed from above. When moved to the extended position, a portion of the clamping arm projects forwardly beyond the footprint of the base. Detents or similar provisions may be provided in the interface between the first portion and the guide opening to bias the clamping arm into one or more preferred positions along the longitudinal axis. A resilient element 153 may be provided to bias the longitudinal position of clamping arm 120. In the illustrated embodiment, clamping arm 120 is biased toward the extended position.

In one embodiment, slide block 152 may be pivotally coupled to the base 102 adjacent to a forward end 107 of the seat enabling clamping arm 120 to be angled as the sliding block is rotated about the transverse axis from the first position toward the second position. Angling of the clamping arm 120 brings distally located clamping foot 124 into contact with the lower surface of the chair seat enabling the seat to be secured to the chair.

In another embodiment, slide block 152 may be connected to base 102 by a linkage 160 including a forward link 162 and a rearward link 164. The links 162, 164 are pivotally coupled at opposing ends to the base and sliding block, respectively, with the opposing pivots 162*a*, 162*b* of the forward link being more closely spaced than the opposing pivots 164*a*, 164*b* of the rearward link. The different lengths of the links cause the slide block 152 to not only be angularly rotated about transverse axis 210 as it moves from the first position to the second position, but also to displace the slide block 152 and clamping arm 120 slightly forwardly in relation to the seat base. The forward displacement of the slide block 152 and the clamping arm 120 improves clearance between the drop-down portion 121 clamping arm and the forward edge of the chair when the seat is installed.

Figure 3:
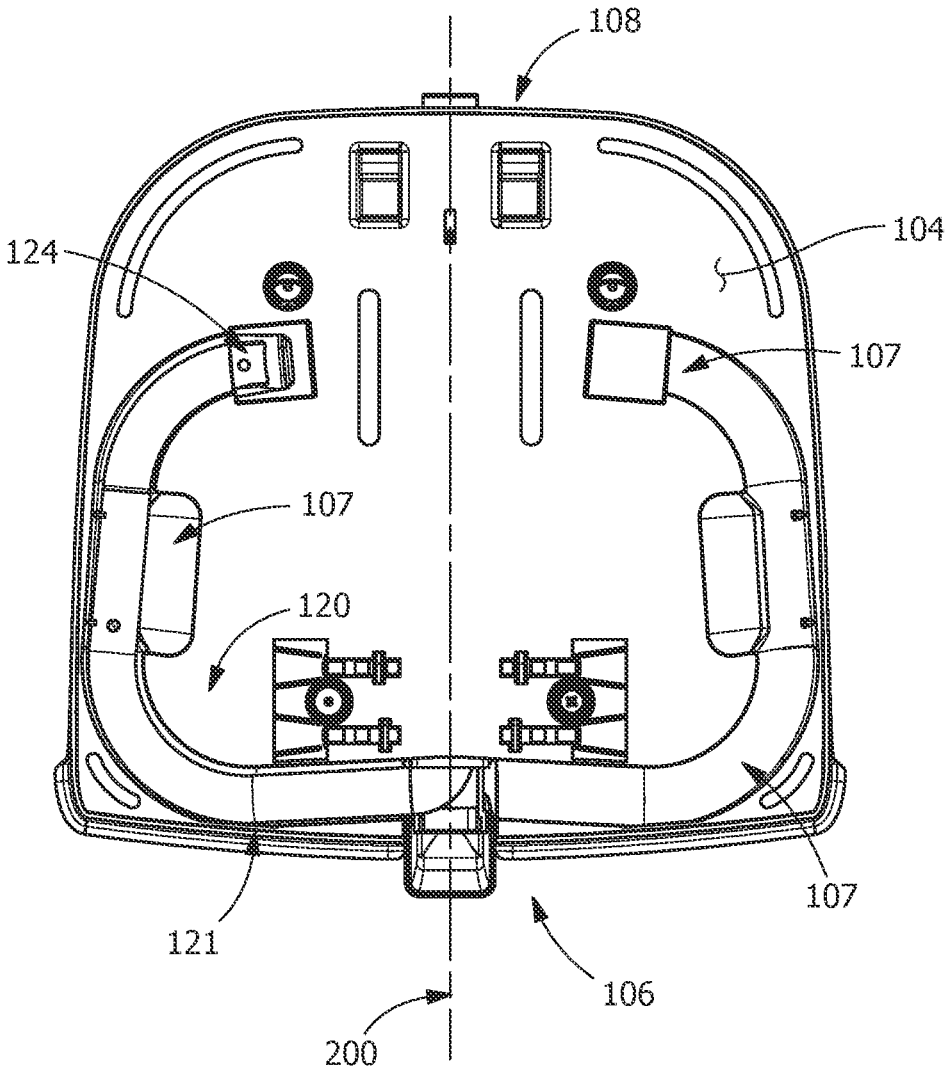
FIG. 3 is a view of the underside of the booster seat of FIG. 1 shown with a seat clamping apparatus in a stowed configuration.

Rotational movement of the clamping arm about the longitudinal axis 200 is enabled by the interface between the first portion of the clamping arm and the guide opening. The rotational movement allows the clamping arm to be positioned in at least one storage position (FIG. 3) and a clamping position (FIG. 5). The clamping position locates the second or distal end 124 of clamping arm 120 generally beneath and spaced apart from lower surface 104 to permit a chair seat to occupy the space between. Rotating the clamping arm to the storage position orients the clamping arm such that it is substantially disposed above the plane of lower surface 104 in a recessed receptacle 107 in the lower surface 104 so that it does not project beneath the lower surface 104. The recess receptacle 107 may include symmetric recesses on either side of longitudinal axis 200 to allow storage of the clamping arm by rotation in either direction from the deployed position. The storage position orientation of the clamping arm allows the lower surface to rest stably adjacent to a generally flat supporting surface.

Moving the clamping arm 120 to the extended position requires rotating the clamping arm 120 approximately 90 degrees about longitudinal axis 200 to the clamping position (FIG. 4) so that it is no longer disposed within the receptacle 107. Once removed from the confines of the receptacle, the clamping arm 120 is urged along longitudinal axis 200 toward the front of the seat by the resilient element 153 until the clamping arm reaches the extended position (FIG. 5). The combined sliding and rotational movement of the clamping arm to simultaneous extended and clamping positions allows the hook formed by drop-down portion 121 and extension portion 127 of the clamping arm to extend around the forward edge to the underside of the chair seat while allowing the bottom surface 104 to fully rest upon the chair seat.

An actuating mechanism 180 is provided to reposition the actuating mechanism 150 and selectively retain the clamping mechanism in the clamped position. The actuating mechanism includes a tensioning structure 182 connecting an anchor connector 151 on the lifting arm 154 and a fixed anchor 187 on the seat structure. The tensioning structure 182 may comprise a web member acting directly or in a force-multiplying loop actuating mechanism to raise and lower the end of lifting arm opposite of the slide block thereby angling the slide block by rotation and repositioning the clamping arm. A cam-lock style web clamp 188 may be provided and affixed to the booster seat structure to enable tension in the tensioning structure, and thereby the clamping force at the clamping foot, to be retained.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

We claim:

1. A portable seat for attachment to a chair to support a child thereon, the portable seat comprising:

a base for supporting the portable seat on a surface, the base having forward and rearward ends;

a clamping arm moveably connected to the base at a first end by a slide block, the slide block being moveable between a first position and a second position and having a guide opening symmetrically arranged about the first axis configured to receive the first end and enable clamping arm movement bi-directionally axially along and rotationally about a first axis; and a lifting bracket connecting the slide block and the base by a linkage comprising a first link and a second link, each link being pivotally coupled at a first end to the base and at a second end to the slide block, the first link and the second link having different lengths which rotate the slide block and the clamping arm about a second axis, the second axis being orthogonal to the first axis, movement of the clamping arm about the second axis altering separation between a clamping foot disposed at a distal end of the clamping arm and the base enabling a portion of the chair to be clamped therebetween.

2. The portable seat of claim 1, further comprising an actuating mechanism configured to selectively move the lifting bracket thereby moving the slide block between the first and second positions, and to releasably retain the slide block in the second position.

3. The portable seat of claim 2, wherein the actuating mechanism comprises a web member extending between a fixed anchor connected to the base and an end of the lifting bracket and a releasable web clamp allows the web member to be tensioned and move the slide connector toward the second position, but inhibits detensioning movement of the web member unless the web clamp is selectively released.

4. A portable seat for attachment to a chair to support a child thereon, the portable seat comprising:

a base including a lower surface, the base configured for supporting the seat on a first surface and having a forward end; and a clamping mechanism connected to the base further comprising:

a slide block connected to the base and moveable by rotation about a transverse axis between a first position and a second position, the slide block having a guide opening symmetrically arranged about a longitudinal axis, the longitudinal and transverse axes being orthogonally aligned;

a clamping arm with a first end configured to engage the guide opening for bi-directional movement along the longitudinal axis between a retracted position, and an extended position in which a portion of the clamping arm projects forwardly from the base, and rotation about the longitudinal axis between a clamping position and a storage position, the clamping arm having a second end with a foot selectively positionable in contact with a second surface planarly opposite to the first surface and beneath the base, movement of the slide block toward the second position while the clamping arm is in the extended position moving the foot into contact with the second surface; and an actuating mechanism configured to selectively move the slide block between the first and second positions and releasably retain the slide block in the second position.

5. The portable seat of claim 4, wherein the lower surface further comprises a recess configured to receive a portion of the clamping arm when in the retracted position, the recess enabling the clamping arm to be disposed substantially above the lower surface when the clamping arm is rotated to the storage position while in the retracted position.

6. The portable seat of claim 5, wherein the slide block is connected to a lifting bracket, the lifting bracket being moveably connecting to the base and enabling rotation of the slide block about the transverse axis.

7. The portable seat of claim 6, wherein the lifting bracket is connected to the base by a linkage comprising a first link and a second link, each link being pivotally coupled at a first end to the base and at a second end to the slide block, wherein the first link and the second link have different lengths.

8. The portable seat of claim 4, wherein the actuating mechanism comprises a web member extending between a fixed anchor connected to the base and an end of the lifting bracket and a releasable web clamp allows the web member to be tensioned and move the slide connector toward the second position, but inhibits detensioning movement of the web member unless the web clamp is selectively released.

* * * * *